US006952848B1

(12) United States Patent
Strunk-Fellows

(10) Patent No.: US 6,952,848 B1
(45) Date of Patent: Oct. 11, 2005

(54) CERVICAL SUPPORT PILLOW

(76) Inventor: Paulette Strunk-Fellows, 335 Daly St., St. Paul, MN (US) 55102

( * ) Notice: Subject to any disclaimer, the term of this patent is extended or adjusted under 35 U.S.C. 154(b) by 0 days.

(21) Appl. No.: 10/636,823

(22) Filed: Aug. 7, 2003

(51) Int. Cl.[7] ..... A47G 9/00
(52) U.S. Cl. ..... 5/636; 5/643; 5/645
(58) Field of Search ..... 5/636, 644, 645, 5/637, 638, 639, 640

(56) References Cited

U.S. PATENT DOCUMENTS

| | | | | | |
|---|---|---|---|---|---|
| 3,840,918 | A | * | 10/1974 | Shave | 5/640 |
| 3,842,453 | A | * | 10/1974 | Redfield | 5/643 |
| 4,768,248 | A | * | 9/1988 | O'Sullivan | 5/640 |
| 4,916,765 | A | * | 4/1990 | Castronovo, Jr. | 5/640 |
| 4,949,411 | A | * | 8/1990 | Tesch | 5/636 |
| 5,819,347 | A | * | 10/1998 | Masuda | 5/641 |
| 6,151,733 | A | * | 11/2000 | Takashima | 5/636 |
| 6,490,743 | B1 | * | 12/2002 | Adat et al. | 5/645 |

FOREIGN PATENT DOCUMENTS

| | | | |
|---|---|---|---|
| DE | G8313300.3 | * | 8/1983 |

* cited by examiner

*Primary Examiner*—Alexander Grosz
(74) *Attorney, Agent, or Firm*—Jacobson and Johnson

(57) ABSTRACT

A cervical pillow and a method of making the pillow comprising a pillow casing a pillow-filling and a cervical support member disposed therein, the pillow-filling forming a head support region and the cervical support member forming a neck support region wherein the neck support region has a greater compression resiliency than the head support region allowing the neck support region to resist against compression and remain a viable source for supporting a user's neck as the head support region compressively supports the user's head thereon. The cervical support member comprises a cylindrical shaped body having tapering ends, and is retained in the pillow casing in a position spaced from the side edges of the pillow.

8 Claims, 3 Drawing Sheets

CERVICAL SUPPORT PILLOW

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

FIELD OF THE INVENTION

This invention relates to pillows, and more specifically to a cervical pillow having a region thereon for providing cushioned support for the user's head and another region thereon for maintaining cervical concavity of a user's neck while maintaining the cosmetic appearance of a traditional pillow.

BACKGROUND OF THE INVENTION

Most people use pillows to provide cushioning support for their head while they rest in order to enhance the user's comfort. Although most pillows provide excellent cushioning support for the user's head by compressively conforming to the user's head, due to the neck's unique curvature the compression of the pillows usually results in improper, and/or insufficient support for the user's neck. Improper or insufficient support of a user's neck may result in the user experiencing muscle strain, headaches, stiff neck, tension and/or fatigue.

Cervical pillows are known in the art. These pillows are specifically designed to provide support for a user's cervical or neck region, especially for those who suffer from neck or back pains. Cervical pillows function by providing a region on the pillow for supporting the user's neck and another region of the pillow for supporting the user's head.

Prior art cervical pillows are typically made from a single material. Due to the curvature of the user's neck, the neck support region of cervical pillows of the prior art usually is shaped differently than the region supporting the user's head so as to enable the neck support region to provide proper support for the user's neck. As a result of the difference in the shapes of the two supporting regions, prior art cervical pillows usually have a distorted and very identifiable design such as a L-shaped or toilette-seat design.

The use of the aforementioned cervical pillow can often result in undesirable cosmetic bedding appearance and uncomfort to the user if house guess happens to notice these pillows and associates the cervical pillow to the user having back or neck problems. In addition, there is also the trouble and expense of having to find specially designed pillow cover for these prior art cervical pillows as traditional pillow covers are not designed for use with cervical support pillows due to their unique shapes.

There thus remains a need for a cervical pillow that provides proper and sustained support for the user's neck, which cosmetically, maintains the appearance of the traditional pillow.

BRIEF SUMMARY OF THE INVENTION

Briefly, the present invention is a cervical pillow comprising a pillow casing, a pillow filling, and a cervical support member. The pillow filling and the cervical support member are both supported within the pillow casing in a manner so as to provide for the cosmetic appearance of a traditional pillow. When supported within the pillow casing the pillow filling forms a head support region on the pillow and the cervical support member forms a neck support region on the pillow wherein the neck support region of the pillow has a greater compression resiliency than the head support region of the pillow. The difference in the compression resiliency of the two regions of the pillow allow the neck support region of the pillow to resist against compression in order to provide proper and sustained support for a user's neck as the head support region compressively supports a user's head thereon.

DESCRIPTION OF THE DRAWINGS

Figure 1:
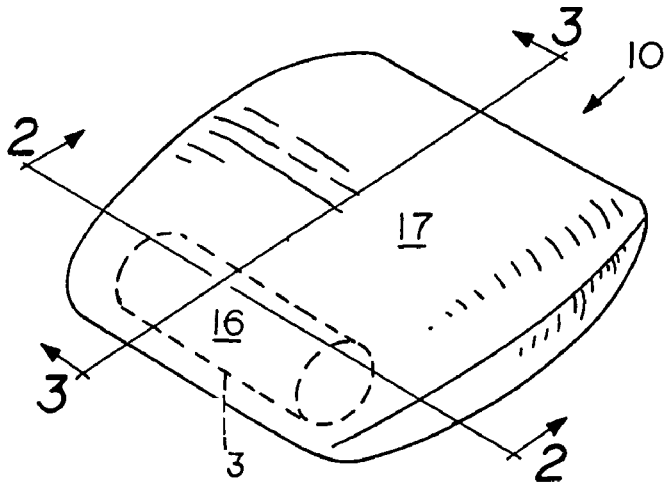
FIG. 1 is a perspective view showing an embodiment of a cervical pillow of the present invention.
Figure 2:
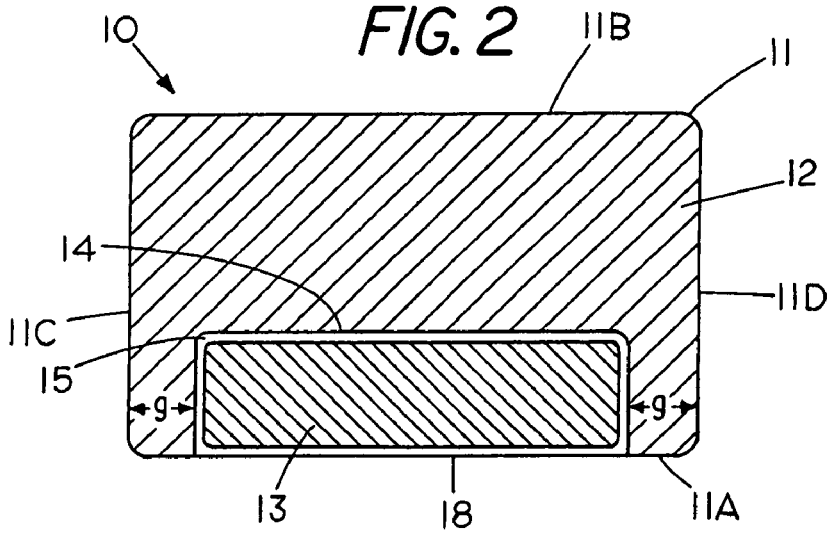
FIG. 2 is a cross-sectional view of the cervical pillow of FIG. 1 taken along the lines 2—2.
Figure 3:
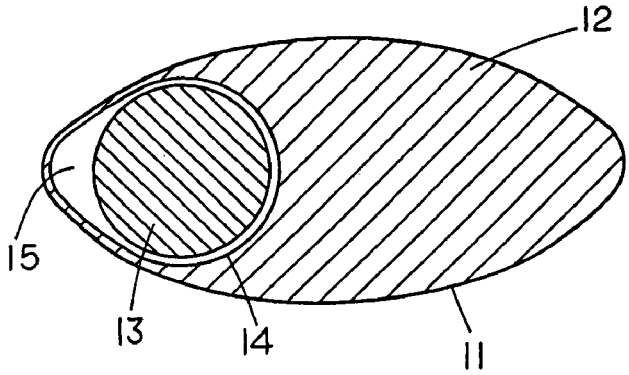
FIG. 3 is a cross-sectional view of the cervical pillow of FIG. 1 taken along the lines 3—3.

FIG. 1 is a perspective view showing an embodiment of a cervical pillow 10 of the present invention. FIG. 2 is a cross-sectional view of the cervical pillow 10 of FIG. 1 taken along the lines 2—2. FIG. 3 is also a cross-sectional view of the cervical pillow 10 of FIG. 1 taken along the lines 3—3.

The cervical pillow 10, as shown in FIGS. 2 and 3, comprises a pillow casing 11, a pillow filling 12 and a cervical support member 13 with pillow filling 12 and cervical support member 13 located within pillow casing 11.

Pillow casing 11 can be formed from any suitable resilient or non-resilient material of the prior art including but not limited to a washable fabric, plastic, and/or nylon. As shown in FIG. 1, when filled, pillow casing 11 provides for a cervical support pillow 10 having the visual appearance of a traditional pillow so as to be indistinguishable from traditional pillows. The shape of and size of cervical pillow 10 also permit the user to use traditional shaped pillow covers with cervical support pillow 10.

Referring to FIG. 2, pillow casing 11 includes a first edge 11A, a second edge 11B, a first end 11C and a second end 11D. Although cervical support member 13, in FIGS. 1–3, is shown located within pillow casing 11 proximal to the first edge 11A of pillow casing 11, cervical support member 13 may also be located at other regions of the cervical pillow in alternative embodiments. Cervical support member 13 functions to form a neck support region 16 on pillow 10 with the neck support region 16 having a compression resiliency sufficient to provide proper and sustained support for the user's neck so as to maintain cervical concavity.

The term compression resiliency, when used to describe the material used in forming the cervical pillow of the present invention, can be defined as the material's firmness or compressibility. Materials that have a higher degree compression resiliency or firmness (i.e. less compressible) have the capacity to provide for greater sustained support. Conversely, materials that have a lower degree of compression resiliency or firmness (i.e. more compressible) are softer and provide for more cushioning but less sustained support.

Although the cervical support member 13 of cervical pillow 10, as shown in FIGS. 1–3, is formed from a cylindrical-shaped compression resilient foam material, the cervical support member of the present invention can also be made from a variety of materials including but not limited to feathers, polyurethane, beads, Styrofoam, polyester filaments, and/or contained fluids. Note that although cervical support member 13 is preferably made from a compressible yet resilient material, a non-compressible and/or non-resilient material may also be used.

It is further noted that the shapes and sizes of the cervical support member of the present invention may also vary so long as their shape and size are sufficient to provide proper and sustained support for the user's neck so as to ensure cervical concavity.

As further shown in FIGS. 2 and 3, occupying the remaining portion of the interior of pillow casing 11 is pillow-filling 12. Similar to cervical support member 13, although a non-compressible and/or non-resilient material may also be used, pillow-filling 12 is preferably made from a compressible yet resilient material. Pillow filling 12 function to form a head support region 17 on pillow 10 with head support region 17 having a compression resiliency sufficient for providing cushioning support for the user's head by comprehensively conforming to the natural shape of the user's head. Examples of suitable materials for pillow filling 12 include but are not limited to feather, polyurethane, beads, Styrofoam™, polyester filaments, and/or contained fluids.

It is noted that due the neck's curvature, the user's neck requires support around the contour of the neck to ensure cervical concavity. To provide for proper support of the user's neck, the present invention provides for the neck support region 16 of pillow 10 having a greater compression resiliency than the compression resiliency of the bead support region 17 of pillow 10. The aforementioned enables neck support region 16 to resist against compression and remains a viable source for supporting the user's neck as pillow 10 compressively supports the user's head thereon.

That is, due to the difference in compression resiliency between neck support region 16 and head support region 17, the compression of pillow 10 results in neck support region 16 having an elevation sufficient for providing proper and sustained support for the user's neck so as to ensure cervical concavity and the head support region 17 having an elevation sufficient to provide cushioning support for the user's head wherein the elevation for supporting the user's neck is different from the elevation for supporting the user's head.

The difference in the compression resiliency of the neck support region 16 versus the compression resiliency of the head support region 17 of pillow 10 ensures cervical concavity during use so as to reduce or eliminate pain resulting from hyperextension and/or awkward positioning of the user's neck during rest while simultaneously providing for soft and gentle cushioning support of the user's head.

In the present invention, although the cervical support member of the prevent invention may be located at different regions within the cervical pillow with the cervical support member being moveable thereabout, it is preferred that the cervical support member be maintained at a specific region within the cervical pillow so that the cervical support member does not move about during support of the user's neck thereon. In view of the aforementioned, the present invention may also include a member for maintaining the cervical support member within a specific region of the cervical pillow. The member for maintaining the cervical support member at the specific region within the cervical pillow may comprise of a variety of materials such as but not limited to a mesh or netting, strings, adhesive, and/or a fluid impermeable barrier such as a plastic envelope.

For example, note that FIGS. 2 and 3 both show a member comprising a lining 14 located within the pillow casing 11, lining 14 forming a chamber 15 within pillow casing 11 for supporting and maintaining cervical support member 13 therein. Lining 14 may be composed of a variety of materials including but not limited to plastic, cloth or nylon (i.e. nylon sleeve). Although the materials of lining 14 ideally allows for stretching, lining 14 can also be formed from a non-stretchable material. Lining 14, as shown in FIG. 2, functions to confine cervical support member 13 to a region proximal to the first edge 11A of pillow cover 11.

Although the lining can be secured to different regions of pillow casing in forming the chamber within the pillow casing, note that lining 14 is shown in FIG. 2 as being secured to the first edge 11A of pillow casing 11 by way of a seam 18.

In further regards to the embodiment of FIGS. 2–3, lining 14 is shown retaining cervical support member 13 to the region of the pillow 10 proximal the first edge 11A of pillow casing 11 with cervical support member 13 being centered between the first end 11C and the second end 11D of pillow casing 11. Since the length of cervical support member 13, as shown in FIG. 2, is less than the length of the first edge 11A of pillow casing 11, the centering of cervical support member 13 results in the formation of gap regions "g" located between cervical support member 13 and the first end 11C of pillow casing 11 and cervical support member 13 and the second end 11D of pillow casing 11. The gap regions "g" allows for movement of pillow-fillings 12 along the ends of the confined cervical support member 13. The presence of pillow-filling 12 within gap regions "g" further provide for the cosmetic appearance of a traditional pillow by visually concealing the presence of cervical support member 13 within pillow 10.

It is noted that when the cervical support member of the present invention is supported within the pillow casing proximal to one of the edges of the casing, the user also has the option of using the other end of the pillow of the present invention in the event the user wishes not to use the cervical support pillow. In addition, unlike cervical pillows of the prior art, the cervical pillow of the present invention provides the user with the option of flipping the pillow over and using the opposite side.

Figure 4:
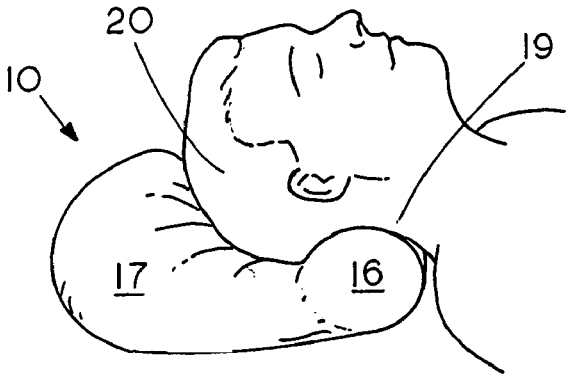
FIG. 4 is a perspective side view showing the use of the cervical pillow of FIGS. 1–3.

Referring to FIG. 4, FIG. 4 is a perspective side view showing the use of the cervical pillow of FIGS. 1–3. In use, a user 18 rest the back of his or her neck 19 on a neck support region 16 while the back of a user's head 20 is cushioned by the head support region 17.

Since the compression resiliency of the neck support region 16 is greater than the compression resiliency of the head support region 17, the neck support region 16, as shown in FIG. 4, compresses less than the head support region 17, thus enabling neck support region 16 to conform to the curvature of the user's neck 19 to provide proper and sustained support for the user's neck thereby ensuring cervical concavity during use to reduce or eliminate pain resulting from hyperextension and/or awkward positioning of the user's neck during rest.

Conversely, since the compression resiliency of head support region 17 is less than the compression resiliency of neck support region 16, head support region 17 of pillow 10 is more compressible then the neck support region 17 of pillow 10 which enables head support region 17 to provide for greater cushioning support of the user's head by comprehensively conforming to the natural shape of the user's head. It is noted that pillow 10 accomplishes the support of both the user's head and neck while still maintaining the overall cosmetic appearance of a traditional pillow.

Figure 5:
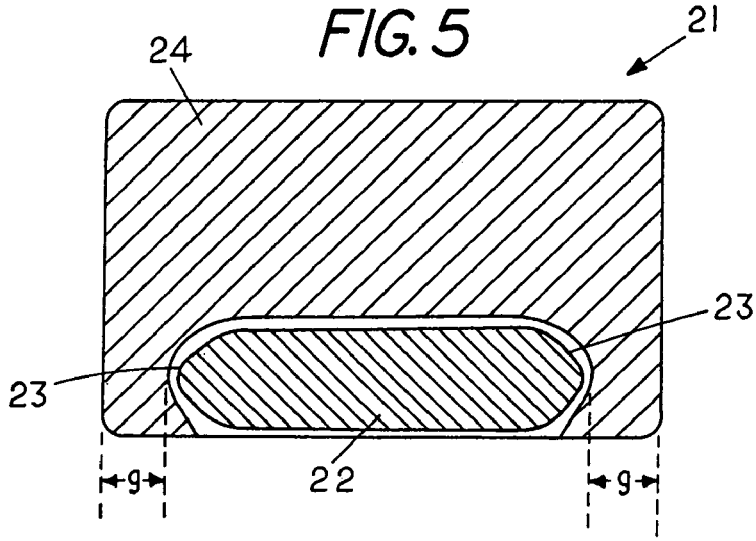
FIG. 5 is a cross sectional view of an alternative embodiment of the cervical pillow of the present invention having a cervical support member with tapering ends.

FIG. 5 shows a cross sectional view of an alternative embodiment of a cervical pillow 21 of the present invention. Cervical pillow 21 is similar to the cervical pillow 10 of FIGS. 1–3 except that the cervical support member 22 of cervical pillow 21 is shown in FIG. 5 as having tapering ends 23. The tapering ends 23 of cervical support member 22 function to provide for less of a drastic drop off in support between the cervical support member 22 and the pillow filling 24 at the gap region "g" of pillow 21.

It is noted that FIG. 5 shows one embodiment in a plurality of conceivable embodiments for the cervical support member of the cervical pillow of the present invention. However, as previously mentioned, the cervical support member of the present invention may comprise of a plurality of shapes and sizes with the only restriction being that the shape and size of the cervical support member is sufficient to provide proper and sustained support for the user's neck to ensure cervical concavity. It is also noted that in alternative embodiments of the present invention in which the cervical pillows varying size, the length and width of the cervical support member will also change to conform to the size of the pillow.

Figure 6:
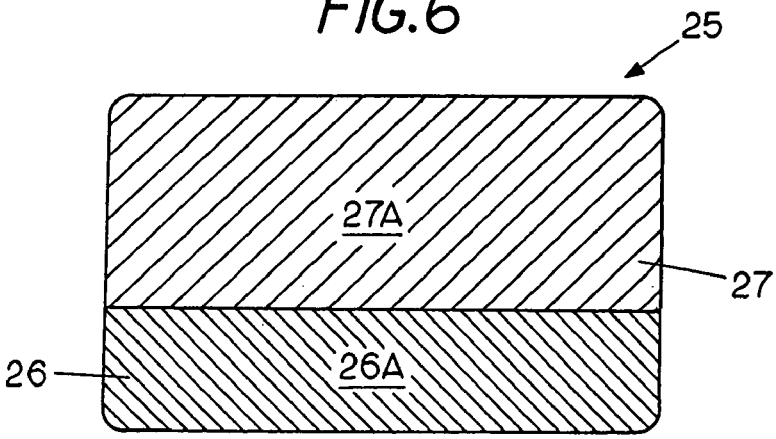
FIG. 6 shows a cross sectional view of an alternative embodiment of the present invention comprising of a one-piece cervical pillow formed from two different materials.
Figure 7:
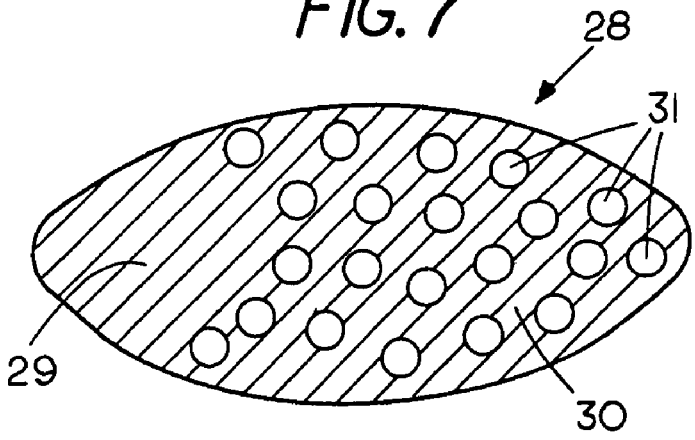
FIG. 7 is a cross sectional view showing an alternative embodiment of the present invention comprising of a one-piece cervical pillow formed from a single material.

Referring to FIGS. 6 and 7, FIGS. 6 and 7 both show alternative embodiments of the present invention comprising of a one-piece cervical pillow. The one-piece cervical pillow can be formed from two or more different materials having different compression resiliency or the same material, so long as the aforementioned one-piece cervical pillow provides for regions thereon having differing compression resiliency to form the neck support region to support the neck at one elevation and head support region to support the head at a different elevation.

Referring to FIG. 6, FIG. 6 is a cross sectional view showing an alternative embodiment of the present invention comprising of a one-piece cervical pillow 25 made from a first material 26A and a second material 27A wherein first materials 26A and second material 27A are different materials. One-piece cervical pillow 25 may be formed from the materials 26A and 27A though a variety of methods including but not limited to molding of the two materials or the binding of the two material together through the use of heat or an adhesive.

As shown in FIG. 6, first material 26A forms a neck support region 26 on cervical pillow 25 and second material 27A forms a head support region 27 on cervical pillow 25. In the embodiment of FIG. 6, the compression resiliency of neck support region 26 is greater than the compression resiliency of head support region 27 wherein the compression resiliency of neck support region 26 is sufficient to ensure cervical concavity during use and the compression resiliency of head support region 27 is sufficient to provide gentle cushioning support for the user's head by conforming to the natural shape of the user's head through compression of head support region 27.

It is noted that the neck support region 26 and the head support region 27 of cervical pillow 25 accomplishes support of the above while still maintaining the cosmetic appearance of the traditional pillow. A conventional pillow cover can be placed around pillow 25 thus providing a cervical pillow with the visual appearance of a conventional pillow.

Referring to FIG. 7, FIG. 7 shows a cross sectional view of an alternative embodiment of a one-piece cervical pillow 28 composed of a single material with pillow 28 having regions thereon with different compression resiliency. The aforementioned is accomplished by varying the internal structure of the neck support region and the head support region of the one-piece cervical pillow.

For example, note that the neck support region 29 of cervical pillow 28 has a higher degree of compression resiliency than the compression resiliency of head support region 30. The difference in compression resiliency of the neck support region 29 versus the compression resiliency of the head support region 30 derives from the introduction of a plurality of cavities 31 within the head support region 30 of cervical pillow 28. The presence of cavities 31 within head support region 30 increases the compressibility of head support region 30 by providing more internal space for compression thereby enabling head support region 30 to provide for greater cushioning support for the user's head than neck support region 29.

In regards to neck support region 29, it is noted that although neck support region 29 is compressible and provides for cushioning support for the user's neck, the lack of cavities therein however results in greater resistance to compression than head support region 30. The aforementioned enables pillow 28 to compressively support the user's head thereon while simultaneously providing for proper and sustained support for the user's neck so as to maintain the user's neck in a proper and natural alignment use.

Figure 8:
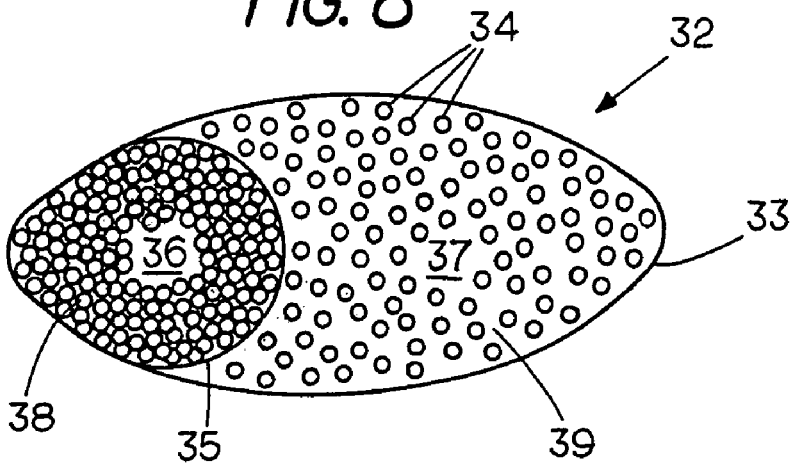
FIG. 8 is a cross sectional view showing an alternative embodiment of a cervical pillow of the present invention having regions thereon with different density.

FIG. 8 is a cross sectional view showing an alternative embodiment of a cervical pillow 32 of the present invention. Cervical pillow 32 comprises a pillow casing 33, a pillow filling 34 and a lining 35. Lining 35 is located within pillow casing 33 and functions to separate the interior of pillow casing 33 into two separate chambers, namely a first chamber 36 and a second chamber 37 with both chambers 36 and 37 supporting pillow filling 34 therein. As previously noted, pillow filling 12 may comprise of a plurality of resilient and/or non-resilient materials such as feather, polyurethane, beads, seeds, Styrofoam, polyester filaments, and/or a contained fluid.

Note in FIG. 8 that first chamber 36 is more tightly packed with pillow filling 34 than second chamber 37 which results in second chamber 37 being more compressible then first chamber 36. That is, the more densely packed first chamber 36 of pillow 28 provides greater sustained support against compression than second chamber 37 with the compression resiliency of chamber 36 being sufficient to provide proper and sustained cushioning support of the user's neck thereby ensuring cervical concavity. The less densely packed second chamber 37 of pillow 28 provides greater cushioning support than first chamber 36 with the compression resiliency of chamber 37 being sufficient to provide cushioning support for the user's head through its compression. The aforementioned results in first chamber 36 forming a neck support region 38 and second chamber 37 forming a head support region 39 on pillow 32 with neck support region 38 having a higher degree of compression resiliency then head support region 39.

The present invention also includes a method of forming the cervical support pillow 10 of the present invention comprising the steps of: (1) forming a pillow casing 11 having a closed end and an open end; (2) filing the pillow casing 11 through the open end of the casing 11 with a pillow-filling 12 to form a head support region 17; (3) placing a cervical support member 13 within the pillow casing 11 to forming a neck support region 16; and (4) closing the open end of the pillow case 11 to prevent the materials therein from escaping. The aforementioned method may also include the step of forming a chamber 15 within the pillow casing 11 for supporting the cervical support member 13 therein.

I claim:

1. A cervical pillow having the visual appearance of a traditional pillow comprising:

a pillow casing, including at least two side edges and at least one end edge spacing said side edges apart;

a pillow-filling located within said pillow casing, said pillow-filling forming a head support region; and a cervical support member comprising a cylindrical shaped body having tapering ends, said cervical support member located within said pillow casing proximal an end edge of said pillow casing, and spaced apart from said side edges, thereby defining gaps, said pillow-filling and said cervical support member disposed within said pillow casing in a manner so as to provide for the cosmetic appearance of an elongated traditional pillow, said cervical support member forming a neck support region wherein said neck support region has a greater compression resiliency than said head support region thereby allowing said neck support region to resist against compression and remain a viable source for supporting a user's neck as said head support region compressively supports the user's head thereon, the pillow further comprising a member for maintaining the cylindrical shaped body proximal to an end edge, with the shape of the cylindrical shaped body concealed within the pillow.

2. The pillow of claim 1 wherein the pillow filling and the cervical support member are composed of different materials.

3. The pillow of claim 1 wherein said member for maintaining comprises a lining, said lining forming a chamber within the interior of said pillow case, said lining secured to a seam located on said pillow casing.

4. The pillow of claim 1, wherein the maintaining member is selected from a group consisting of a lining, a barrier, an adhesive, a string, a mesh or a netting.

5. A cervical support pillow comprising:

a pillow casing including at least two side edges and at least one end edge spacing said side edges apart;

a first material and a second material disposed within said pillow casing in a manner so as to provide for the cosmetic appearance of a traditional pillow, said first material comprising a cylindrical shaped body with tapering ends, said first material located proximal an end edge of said pillow casing, and spaced apart from said side edges, thereby defining gaps, said first material forming a neck support region having an elevation sufficient for providing proper and sustained support for the user's neck so as to ensure cervical concavity; said second material forming a head support region having an elevation sufficient to provide cushioning support for the user's head wherein the elevation for supporting the user's neck is different from the elevation for supporting the user's head, the pillow further comprising a member for maintaining the cylindrical shaped body proximal to an end edge, with the shape of the cylindrical shaped body concealed with the pillow.

6. The pillow of claim 5 wherein the first material and the second material are composed of different materials.

7. A method of forming a cervical support pillow comprising the steps of:

forming a pillow casing having a closed end and an open end;

filing the pillow casing through the open end of the casing with a pillow filling to form a head support region;

placing a cervical support member having cylindrical shaped body with tapering ends within the pillow casing proximal an edge of the pillow casing to form a neck support region, the cervical support member being placed in a position proximate a lower edge of the casing and adapted to be maintained by a maintaining member in a position spaced from side edges of the casing; and closing the opened end of the pillowcase to prevent the materials therein from escaping.

8. The method of claim 7 including the step of forming a chamber within the pillow casing for supporting the cervical support member therein.

* * * * *